United States Patent [19]

Wern

[11] Patent Number: 4,769,956

[45] Date of Patent: Sep. 13, 1988

[54] ABRASIVE CLEANING AND TREATING DEVICE

[75] Inventor: Michael J. Wern, Orland Park, Ill.

[73] Assignee: Engineered Abrasives, Inc., Worth, Ill.

[21] Appl. No.: 92,158

[22] Filed: Sep. 2, 1987

[51] Int. Cl.[4] ..... B24C 3/12; B24C 3/20

[52] U.S. Cl. ..... 51/421; 51/436; 51/410

[58] Field of Search ..... 51/410, 436, 428, 437, 51/438, 439, 419, 421, 426, 415, 427

[56] References Cited

U.S. PATENT DOCUMENTS

| | | | |
|---|---|---|---|
| 3,139,704 | 7/1964 | McCune | 51/436 |
| 4,389,820 | 6/1983 | Fong | 51/410 |
| 4,569,159 | 2/1986 | Wern | 51/428 |
| 4,614,100 | 9/1986 | Green | 51/415 |

*Primary Examiner*—Frederick R. Schmidt
*Assistant Examiner*—Bradley I. Vaught
*Attorney, Agent, or Firm*—Trexler, Bushnell, Giangiorgi & Blackstone, Ltd.

[57] ABSTRACT

A cleaning and treating apparatus which employs a series of nozzles or guns for propelling abrasives into interior and exterior exposed surfaces of components. The forces required to propel the abrasive materials are provided by fluid pressure supply sources which can be adjusted separately to deliver a wide range of high and low pressures to each individual nozzle outlet. Having available these variably selectable fluid pressure sources at each individual nozzle, combined with means for directing each nozzle relative to the machined component being cleaned or treated, enables this apparatus to perform its intended function without distorting the surfaces upon which the work is being performed. Furthermore, it allows an operator of the unique apparatus to correct any existing surface disconfigurations or otherwise control the shape of the component as desired.

7 Claims, 2 Drawing Sheets

ABRASIVE CLEANING AND TREATING DEVICE

BACKGROUND OF THE INVENTION

This invention relates to an abrasive cleaning and treating device commonly used for cleaning and treating metal components such as round bands, rings and cylinders. It will be appreciated however, that such a device may have many other applications and that this invention is therefore not intended to be limited to the applications discussed above.

More particularly, this invention relates to the type of abrasives distributing device disclosed in U.S. Pat. No. 4,569,159 which shows an abrasives distributor employing a series of blast nozzles variably directable in relation to the workpiece being treated as well as being rotatable about an axis relative to the workpiece.

The device in U.S. Pat. No. 4,569,159 also discloses means for supplying abrasive materials to each nozzle means and means for supplying a uniform level of fluid pressure, from a single pressure source, capable of providing sufficient force to blow the abrasive materials through the nozzle means outlet orifices.

While the abrasives distributor patented as U.S. Pat. No. 4,569,159 represented a significant improvement over the prior art devices when patented, the present invention represents a further significant advantage in the art.

In the field in which the present invention is designed to function, the problem of workpiece disconfiguration is often encountered. That is, the routine cleaning or treating of a workpiece can cause the surface configuration to become significantly distored. This kind of surface distortion can greatly impair the value of some workpieces and render others totally useless.

BRIEF SUMMARY OF THE INVENTION

A primary objective of this invention is to provide an abrasive cleaning/treating apparatus for cleaning and treating components without causing disconfiguration of the component surfaces in the process.

A further object of this invention is to provide an abrasives cleaning/treating apparatus for controlling and correcting existing surface disconfigurations on components.

Summarily stated, the invention comprises a series of directable nozzle means for directing abrasives at selected workpiece surfaces. Abrasives are supplied to the nozzle means initially from a suitable supply hopper which then feeds the abrasive materials into a receptacle which forms a part of the cleaning/treating device. Once the abrasives are loaded into the integrated receptacle, they are channeled through conduits between the receptacle and each of the nozzle means as required.

In the embodiment shown and described, fluid pressure force for propelling the abrasive materials out of each nozzle means and into contact with the component surfaces being treated is provided by a fluid pressure supply means which is discussed in detail below. The fluid pressure supply means provides the operator of the abrasives cleaning/treating device with a choice of at least one variable high pressure fluid source and at least one variable low pressure fluid source for each nozzle means provided.

Preferably, the nozzle means are arranged such that a nozzle means supplied by high pressure can be positioned to propel abrasives onto one surface of the piece being treated while a nozzle means supplied by low pressure simultaneously sprays an opposing surface of the component with abrasives from an opposing direction, or vice versa as required by the particular characteristics of the component being treated. It is in this manner that parts can be abrasively cleaned and treated by the inventive device without suffering from surface disconfiguration.

Alternatively, the nozzle means and fluid pressure supply means can be arranged to direct abrasives at varying pressure levels for the purpose of reclaiming out-of-tolerance components or correcting and changing component surface configurations as otherwise desired.

To further expand the adaptability of the inventive cleaning and treating apparatus for use on an wide range of part sizes and configurations, means for rotating the nozzle means about a common axis and rotating a worktable upon which the components are placed are also provided.

DESCRIPTION OF THE PREFERRED EMBODIMENT

Figure 1:
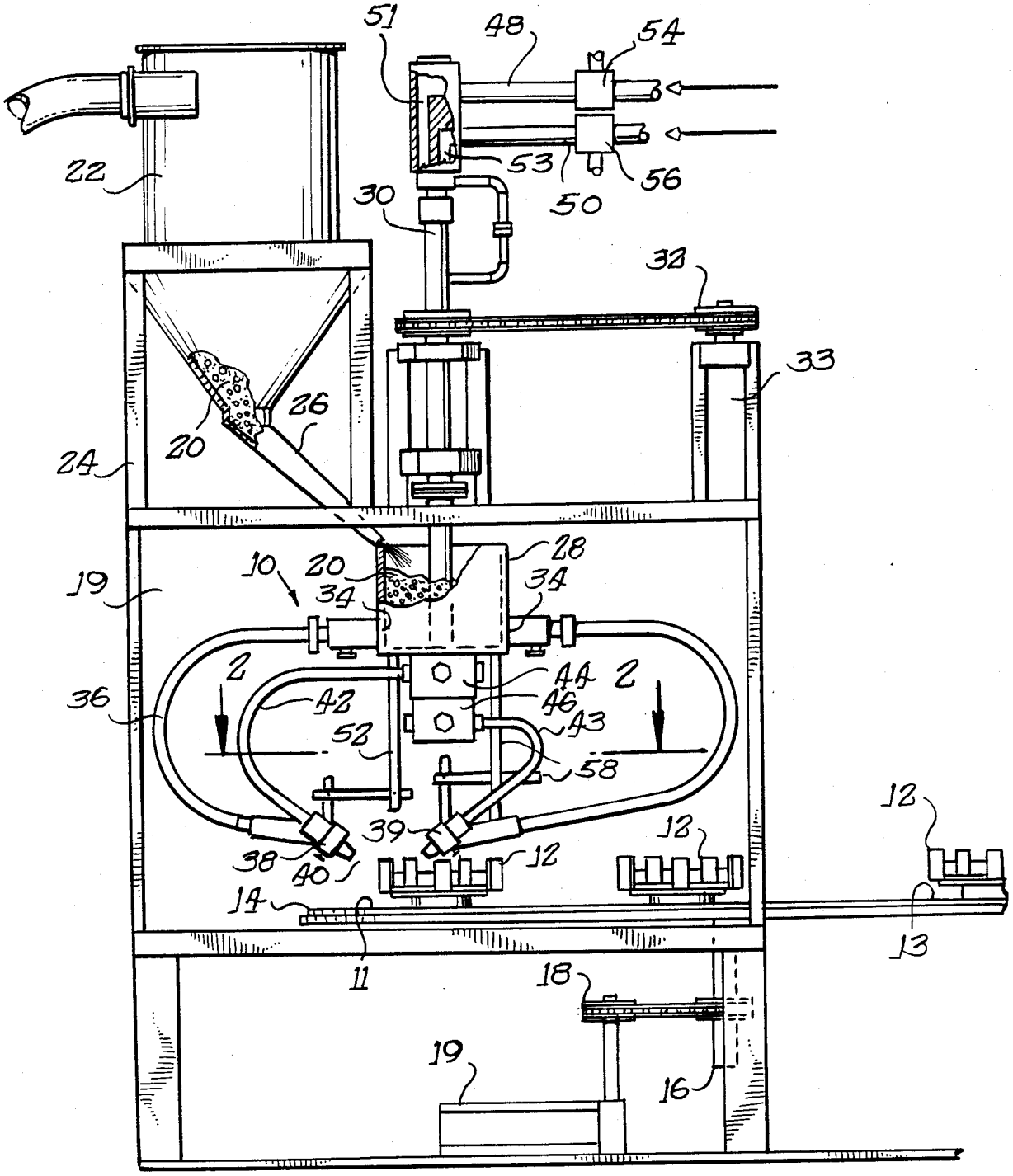
FIG. 1 is a side view of the abrasive cleaning and treating device.

FIG. 1 shows an abrasive cleaning and treating apparatus 10 for use on a wide variety of machined, cast or otherwise formed parts and components, usually formed from metal but not necessarily limited thereto. Some examples of the type of parts requiring this type of cleaning and treating are piston cylinders, round bands, and machined rings.

Parts 12 selected for cleaning and/or treatment are placed on a work table 14 which is rotatable on a shaft 16 driven by a pulley 18. Drive means 19 provides driving force to the pulley 18 in a known fashion.

Rotation of the work table 14 relative to abrasive applying means described below, provides an efficient method by which a continual succession of parts can be loaded and unloaded for treatment without having to shut down the cleaning/treating apparatus between part batches.

For example, after a particular part 12 is cleaned or treated, the work table 14 will rotate that part 12 away from a cleaning/treating station 11 where it can be removed and replaced with another part 12 at a loading and unloading station 13 located away from the cleaning/treating station 11, none of which requires the operation of the apparatus to be shut down.

It will also be noted that a suitable enclosure 19 can be provided to surround the cleaning and treating apparatus 10 to prevent the operator of the device from being exposed to the propelled abrasives 20 discussed below. Such an enclosure would be provided with sliding doors on both sides to allow entry and exit of the components being treated while simultaneously preventing abrasives from escaping the enclosure.

In keeping with the principal objectives of the invention, common abrasive materials 20 are stored in a supply hopper 22 of known configuration mounted on a rigid support structure 24.

The hopper 22, preferably has a funnel outlet portion 26 from which common abrasives 20 (such as sand or other suitable abrasive particles) flow out of and then into an abrasives receptacle 28.

In the illustrated form, the cleaning/treating apparatus 10 further comprises a central shaft member 30 vertically mounted for rotation in the support structure 24, adjacent to the supply hopper 22. The shaft member 30 is rotationally driven by an upper pulley 32, similar to the pulley 18 which drives the worktable 14. The upper pulley 32 can be driven at various speeds by a second independent drive means 33 also of known type and kind.

In the illustrated form, the abrasives receptacle 28 is cylindrically shaped and is preferably fixed for rotation with the central shaft member 30 which is positioned to pass directly through the center of the bottom of abrasives receptacle 28. In order to prevent abrasive materials 20 from running through any remaining open areas surrounding the circumference of the shaft member 30 where it passes through the abrasives receptacle 28, suitable sealant should be provided.

In operation, central shaft member 30 is rotated about its vertical axis as described above. Abrasives then pass out of the receptacle 28 via at least two passageways 34 bored in the lower portions of the receptacle's cylindrical side wall. Abrasive conduit means 36 are there provided to channel the abrasives to nozzle means 38 and 39 which are provided in number equal to the quantity of passageways 34. Appropriate sealing is provided for conduit means 36 at points of connection with both passageways 34 and nozzle means 38 and 39.

Figure 2:
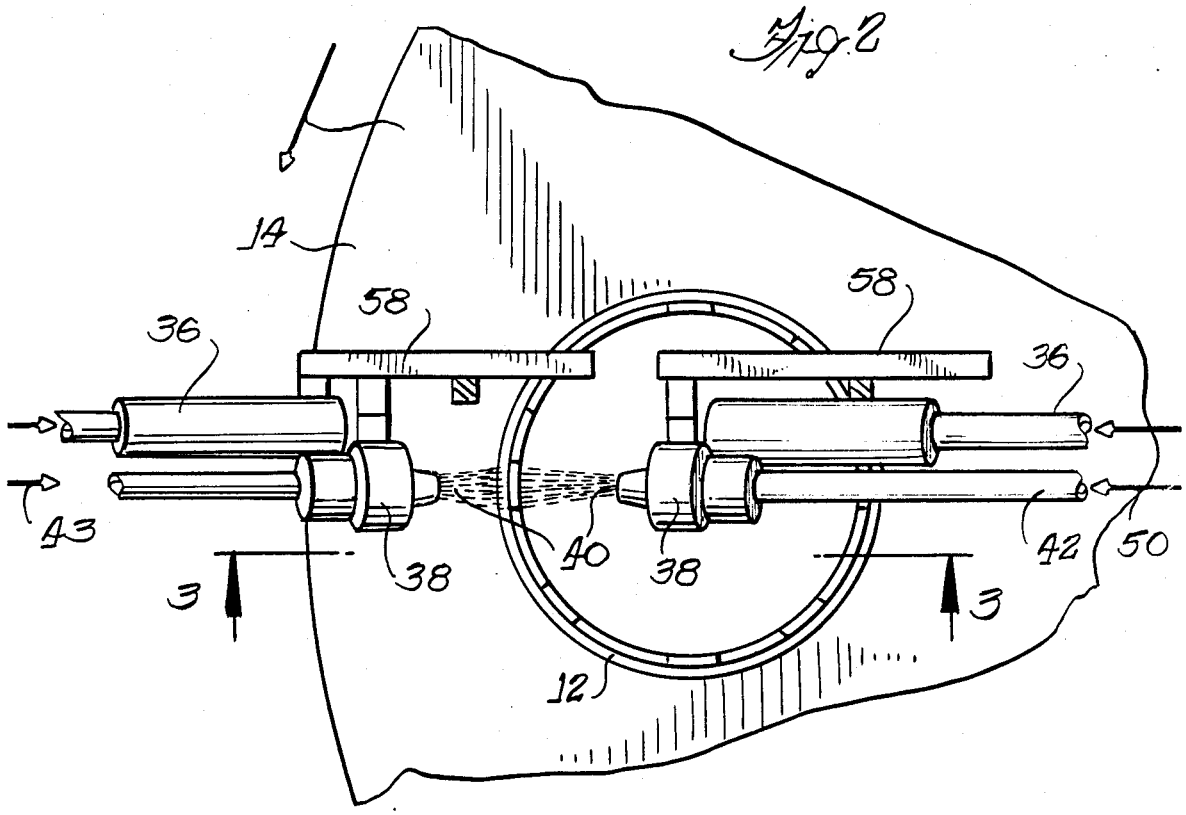
FIG. 2 is an enlarged top view of the nozzle means portion of the abrasive cleaning and treating device.
Figure 3:
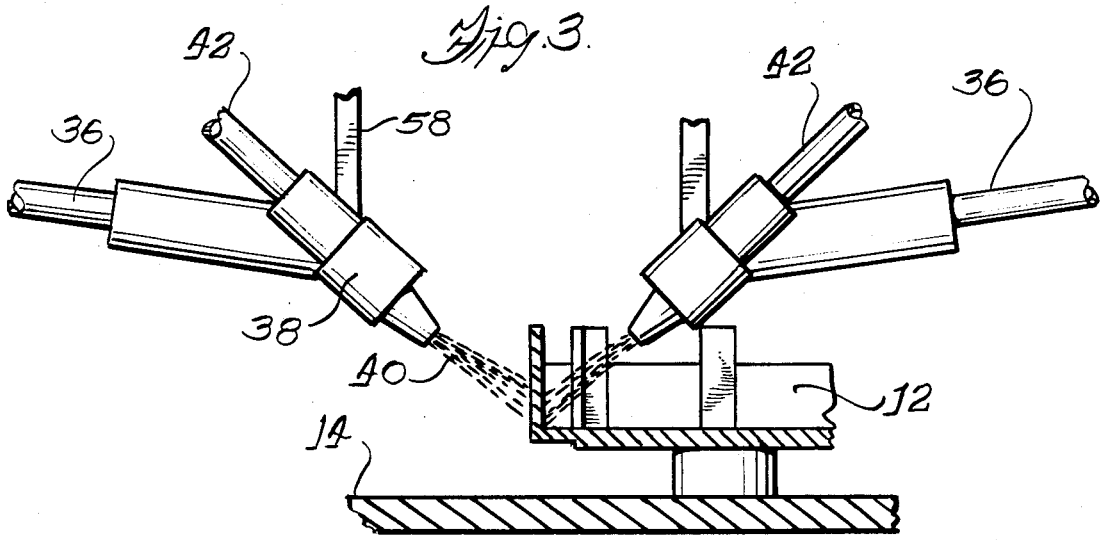
FIG. 3 is a side view of the nozzle means portion also on an enlarged scale.

Each nozzle means 38 and 39 has an open end 40 substantially opposite its point of connection with the associated abrasive conduit means 36, as best seen in FIG. 2. It is through this suitably shaped opening 40 that the abrasive materials 20 are actually propelled into surface contact with the parts 12 on the worktable 14.

It will be noted that the velocities at which the abrasive masses 20 emerge from the nozzle means opening 40 exponentially relate to the kinetic energy associated with each abrasive mass 20 at that moment in time. It follows therefrom, that a slight change in the emerging velocities of the abrasive particles 20 causes a relatively substantial variance in the total work preformed on the surface configurations of the parts 12 being treated. This is true because the total work performed equals the difference between the kinetic energy of the abrasive masses when they leave the nozzle means opening 40 and the kinetic energy of the abrasive masses at a point just after contact with the parts 12 being cleaned or treated. Therefore, the capability of controlling the velocities at which the abrasives 20 exit the nozzle means 38 and 39 results in the ability to control the total work performed on the workpiece surfaces. This capability in combination with other features discussed below, creates the capacity to prevent surface distortion caused by the total work performed, hereafter referred to as abrading energy.

Depending on various factors, including the particular stress and strength characteristics and the individual structural shapes of the parts 12 being treated, preventing surface disconfiguration may entail simultaneously impacting various part surfaces with various degrees of abrading energy.

In the embodiment shown, at least one of the nozzle means 38 is positioned to direct abrasive material against the outer peripheral surface of the part 12 while at least one other of the nozzle means 39 is positioned to direct abrasive material against an inner surface of the part 12, preferably directly opposite from the nozzle means 38.

Additionaly, each nozzle means 38 and 39 is provided with an associated fluid pressure conduit means 42 or 43 which ultimatly communicates with a variable fluid pressure source as discussed in detail below.

As best seen in FIG. 2, each fluid pressure conduit means 42 or 43 is operatively connected to its associated nozzle means 38 or 39, adjacent the nozzle means' connection point with its associated abrasive conduit means 36.

The opposite end of each fluid pressure conduit means 42 and 43 is operatively attached to separate fluid pressure supply manifold means 44 and 46 as shown in FIG. 1. The fluid pressure supply manifold means 44 and 46 are preferrably rotationally fixed to the center shaft member 30 and disposed in series below the abrasives receptacle 28.

In the illustrated form, two separate fluid pressure sources are shown. The first source 48 supplying a relatively high range of variably selectable pressures between approximately 0 p.s.i. to 120 p.s.i., and the second fluid pressure source 50 supplying a relatively low range of variably selectable pressures between 0 p.s.i. to 120 p.s.i. Both the first fluid pressure source 48 and the second fluid pressure source 50 are channeled through hollow center conduits 51 and 53 located in the central shaft member 30 until independently connecting with manifolds 44 and 46, respectively. Consequently, each nozzle means 38 and 39 is suitably equipped with a supply of abrasives 20 and either variable high pressure from source 48 or variable low pressure from source 50 capable of propelling the abrasives 20 at selected target areas on the exposed interior and exterior component part surfaces requiring treatment.

Means for selectively controlling the variable pressures available from high pressure source 48 and low pressure source 50 is provided by electrical or mechanical valve means 54 and 56, respectively. As shown in FIG. 1, preferably the valve means 54 and 56 are positioned on sources 48 and 50 to the right of where the pressure sources enter central shaft member 30.

It will be appreciated however that the number and location of independent fluid pressure sources, valve means and associated supply manifold means provided can be varied according to desire.

It will also be apparent that fluid pressure sources 48 and 50 can originate from a single source having the capacity to supply a wide range of high and low fluid pressures or from separate high and low pressure supplies, either arrangement being suitably regulated by valve means 54 and 56.

As best shown in FIG. 1, omnidirectional positioning of the nozzle means 38 and 39 is provided by directional means 52. Preferably, the directional means 52 comprises a series of links 58 which are connected to the nozzle means 38 and 39, the abrasives receptacle 28 and also with each other. By employing these links 58, nozzle means 38 and 39 can be pointed directly downward and parallel to central shaft member 30, perpendicular to central shaft member 30, or at any intermediate angle in between.

The combination of the range of motion provided by directional means 52 and the 360 degree rotational capability of central shaft member 30 discussed above, makes the nozzle means 38 and 39 directable at any conceivable workpiece surface presented.

While a preferred embodiment of the present invention has been shown and described, it is of course evident that many changes may be made without departing from its spirit and scope.

The invention is claimed as follows:

1. An apparatus for propelling abrasives onto selected surfaces of manufactured goods for treating said surfaces without causing surface disconfiguration or for correcting existing surface disconfiguration, said apparatus comprising: at least a first and second abrasive propulsion nozzle means for propelling abrasives within a predetermined range of velocities and thereby applying varying levels of abrading energy to said surfaces; fluid supply means having at least two independent fluid pressure supply sources corresponding to said first and second abrasive propulsion nozzle means for supplying independent selectable fluid pressure to each of said first and second propulsion nozzle means; means for controllably directing said propulsion nozzle means relative to the surfaces of said manufactured goods being treated; and abrasive supply means for supplying abrasives to said propulsion nozzle means.

2. The apparatus of claim 1 wherein said fluid supply means comprises adjustable valve means for independently and selectively controlling the level of fluid pressure delivered by said fluid supply means to each of said propulsion nozzle means thereby enabling regulation of the component surface configurations.

3. The apparatus of claim 2 wherein at least one of the at least two independent fluid pressure supply sources is capable of providing a variable range of relatively high fluid pressures and at least one of the at least two independent fluid pressure sources is capable of providing a variable range of relatively low fluid pressures.

4. A surface treating apparatus for simultaneously treating and selectably controlling work piece surface configurations comprising means for directably distributing at least two separate streams of abrasive projectiles onto different portions of said surfaces with sufficient force to so treat and regulate said surface configurations, means for independently controlling the velocities at which the separate streams of abrasive projectiles exit said directable distributing means, and means for supplying a sufficient amount of abrasive projectiles to said treating apparatus.

5. The surface treating apparatus of claim 4, wherein the means for controlling the velocities at which the separate streams of abrasive projectiles exit said directable distributing means and impact said surface configurations comprise a fluid pressure supply means.

6. The surface treating apparatus of claim 5, wherein said fluid pressure supply means comprises at least one high and at least one low variable pressure sources individually attached to said directable distributing means such that said surface treating apparatus is always connected to at least one high and at least one low pressure source.

7. The surface treating apparatus of claim 6, wherein said fluid pressure supply means further comprises valve means for selectably controlling each of said variable fluid pressure sources independently and thereby providing independent control of the velocities of the abrasive projectiles being discharged from said directable distributing means.

* * * * *